United States Patent [19]

Lee

[11] 3,938,208

[45] Feb. 17, 1976

[54] KNOCKOUT MECHANISM FOR A HIGH-SPEED AUTOMATIC COLD HEADING MACHINE

[76] Inventor: Yuan Ho Lee, 85, Jen Ho Road, Tainan, China /Taiwan

[22] Filed: Aug. 15, 1974

[21] Appl. No.: 497,728

[52] U.S. Cl. ..... 10/11 E

[51] Int. Cl.[2] ..... B23G 11/00; B21D 45/00

[58] Field of Search ..... 10/11 R, 11 E, 12 R, 12.5; 72/427; 74/25, 89, 116, 117

[56] References Cited

UNITED STATES PATENTS

| | | | |
|---|---|---|---|
| 1,026,082 | 5/1912 | Duston | 10/11 E |
| 1,412,844 | 4/1922 | Clouse | 10/11 E |
| 2,271,257 | 1/1942 | Friedman | 10/11 E |
| 2,768,394 | 10/1956 | Ward | 10/13 |
| 3,171,144 | 3/1965 | Maistros | 10/11 E |

*Primary Examiner*—C. W. Lanham
*Assistant Examiner*—E. M. Combs
*Attorney, Agent, or Firm*—Lane, Aitken, Dunner & Ziems

[57] ABSTRACT

A knockout mechanism for a high-speed automatic cold heading machine having first and second eccentric shafts. A driving link is mounted on the first eccentric shaft by an antifriction bearing. A rocker arm is pivotally connected to the driving link at a location spaced from the connection of the link to the first shaft. The rocker arm is connected to the second shaft so that the rocker arm continuously oscillates. Knockout means including an ejecting rod are actuated by the rocker arm to eject a blank from a die of the machine. The stroke of the rocker arm is adjusted by adjusting the second eccentric shaft.

3 Claims, 4 Drawing Figures

KNOCKOUT MECHANISM FOR A HIGH-SPEED AUTOMATIC COLD HEADING MACHINE

BACKGROUND OF THE INVENTION

The present invention relates to a knockout mechanism for a high-speed automatic cold heading machine and more particularly to a knockout mechanism of a heading machine for bolts whose body and head are substantially different in size and of somewhat complex forms. The heading macnine herein referred to is capable of forming rivets, tubular rivets, socket-head screws, hexagon-head screws, wood screws and bolts thereof, machine screws, automobile bolts, tapping screws and screws having cross recess style round-heads, counter sunk heads, oval heads, square heads and the like.

A conventional knockout mechanism for heading machines generally used in the art is shown in FIG. 1. A rocker arm 2 is pivotedly connected to a pin 21 and moves with the pin 21 as the fulcrum. The lower end of the arm 2 is fixed with rollers 22 which are impacted by a cam 31 driven by a rotating shaft 3. An ejecting rod 1 is correspondingly impacted by an adjusting bolt 5 fixed at the upper end of said rocker arm 2 to eject the finished blank 4 out of the dies 6.

The construction mentioned above is complex in structure, especially since the rollers 22 of the rocker arm 2 are impacted once for every revolution of the cam 31 on the rotating shaft 3 to move the rocker arm 2 for accomplishing the knockout operation. Thus, it has been found that the impacting forces or shock load are always applied to some specific portions of the parts for the ejecting operation, whereupon the parts wear readily. Errors will then easily occur and the timing for performing wire feeding and cutting operations, and upsetting and knockout operations cannot easily and accurately be coordinated during the sequence of operations. Thus, it is impossible to obtain a hign-speed and very stable heading operation.

SUMMARY OF THE INVENTION

The primary object of the present invention is an improvement to overcome the defects mentioned above and to provide a knockout mechanism, wherein, a rocker arm is pivoted on an adjustable eccentric pin as its fulcrum and is capable of oscillating motion. The lower end of the said rocker arm is connected with a pin to one end of an oscillating crank which is firmly mounted to a driving eccentric shaft by means of at least one antifriction bearing at its other end. An adjustable bolt is furnished at the top end of the said rocker arm, as mentioned above. Thus, with the above-mentioned knockout mechanism, the knockout operation will be accomplished smoothly and accurately, and no concentrated load will exist to produce local wearing of parts. A precise coordination of timing between successive wire feeding, cutting, upsetting and knockout processing, results in a high-speed and very stable heading operation.

A further object of the present invention is to provide a knockout mechanism with little or simplified construction, of no malfunctions, of long life and of high product quality to be used in high-speed automatic cold heading machine.

BRIEF DESCRIPTION OF THE DRAWINGS

Other objects and features of the present invention will become more apparent when taken in conjunction with the accompanying drawings, in which.

DETAILED DESCRIPTION OF THE PREFERRED EMBODIMENT

Figure 1:
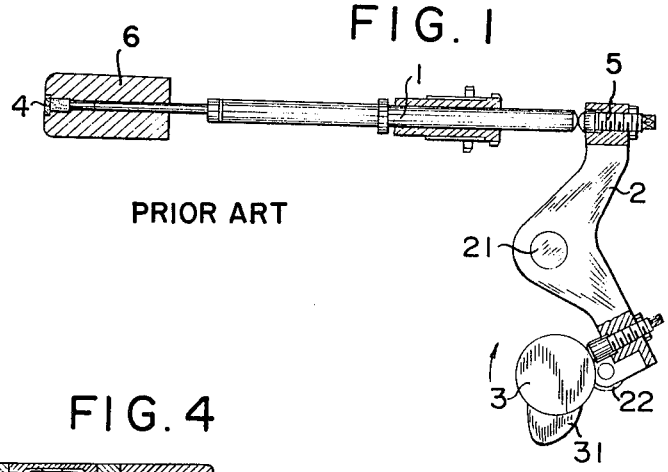
FIG. 1 shows a cross-sectional front view of a knockout mechanism in prior art partially in section.
Figure 4:
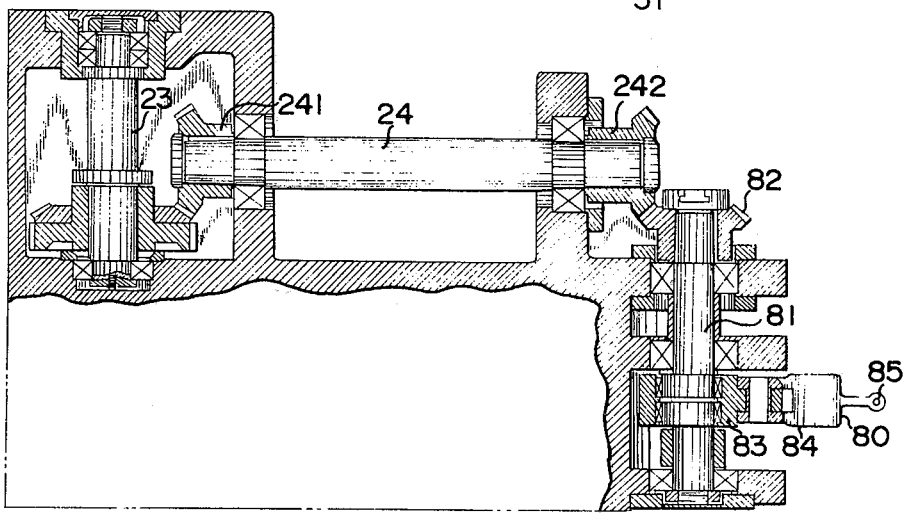
PRIOR ART FIG. 4
FIG. 4 depicts a side cross-sectional view similar to FIG. 2, and taken along a plane of the cold heading machine which includes the coupling shaft.
Figure 2:
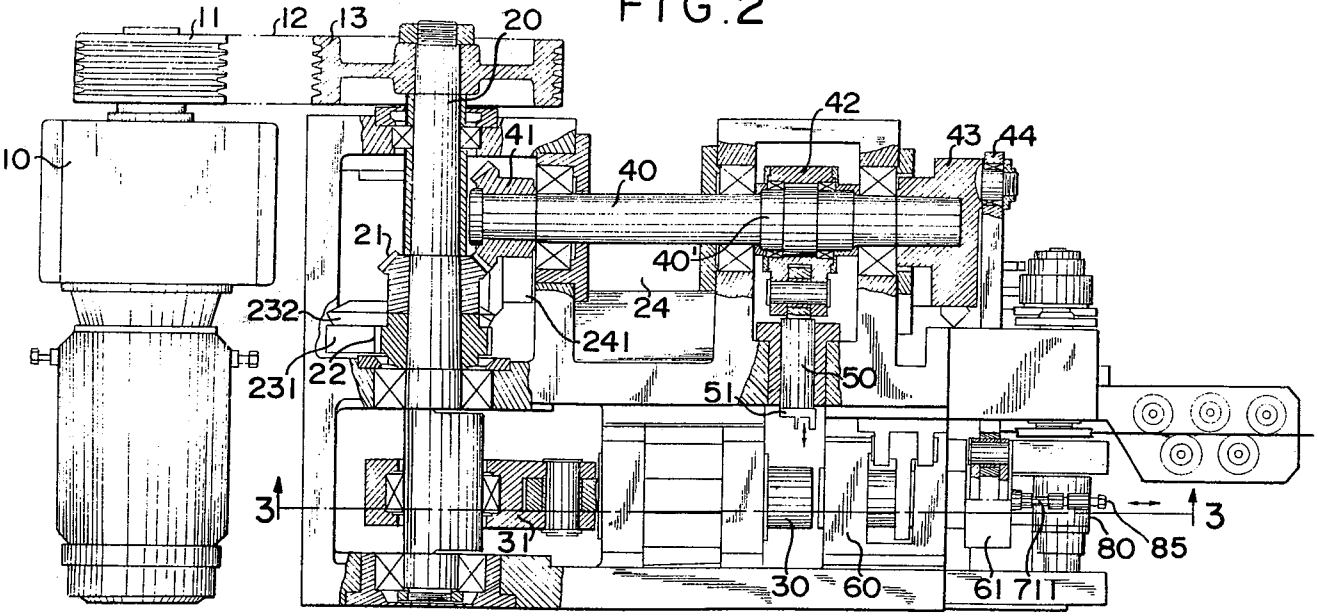
FIG. 2 shows a plan view partially in cross-section of the high-speed, automatic heading machine of which the knockout mechanism of the present invention is used.

In the figures the primary source of motive force is the main eccentric shaft 20 driven by a V-belt pulley 13 which is driven by a V-belt pulley 11 on a motor 10 by way of the V-belt 12. A bevel gear 21 and a spur gear 22 are keyed on the main eccentric shaft 20. A main slide-block-connecting rod 31 for a reciprocating block 30 is pivotally connected to the shaft 20. The spur gear 22 on the main eccentric shaft 20 is engaged with a spur gear 231 fixed on a rotating short shaft 23 below the shaft 20 (see FIG. 4), so that the spur gear 231 coupled with a bevel gear 232 as one unit rotates simultaneously therewith. One end of the coupling shaft 24 having a bevel gear 241 is engaged with the bevel gear 232. On the other end of the coupling shaft 24 is fixed a bevel gear 242 engaged with the bevel gear 82 which drives a knockout eccentric shaft 81 on which a knockout connecting member 83 is mounted by means of an antifriction bearing to the knockout eccentric shaft 81. The knockout connecting member 83 is further connected to a rocker arm 80 which is slipped over the eccentric shaft 84 which uses the shaft 84 as a fulcrum for oscillating motion (see FIG. 3), results in a simplified construction and an extremely high-speed and accurate operation. When the rotary die head 60 is revolving one pitch between two dies through a ratchet 601 and a pawl 602, an adjusting ram bolt 85 of the knockout mechanism impacts an ejecting rod 711 of the rotary die head 60 to eject the finished blank, and the length of the stroke is freely adjusted by those eccentric shafts.

Figure 3:
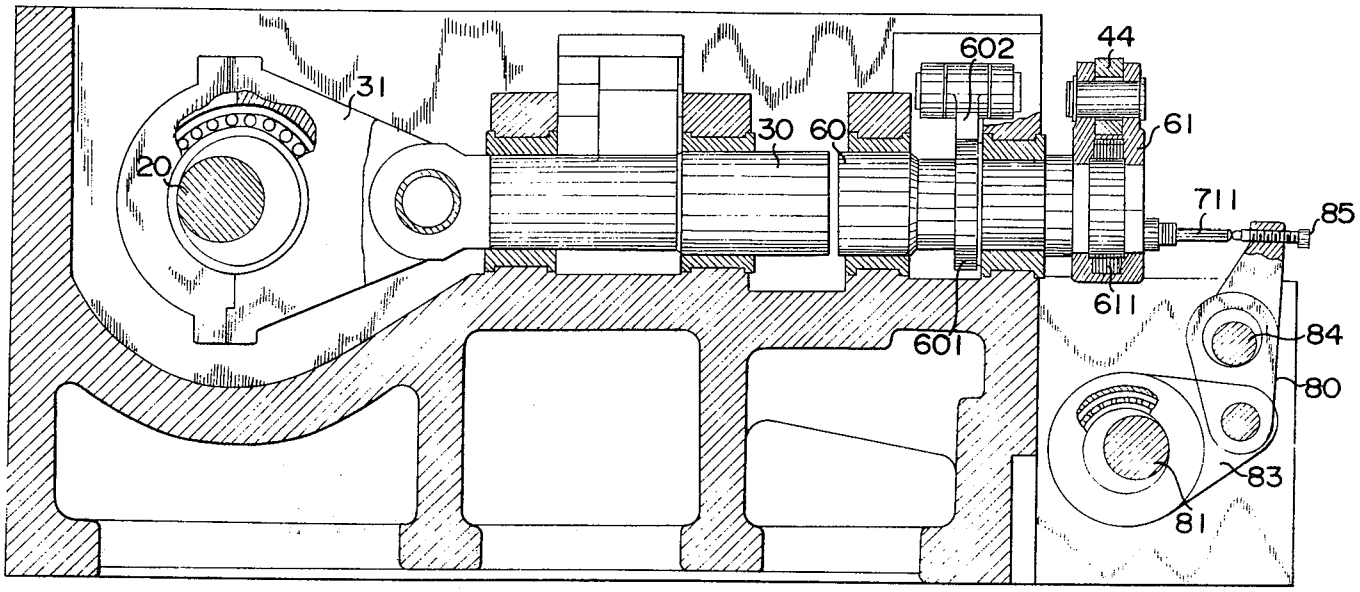
FIG. 3 depicts a side cross-sectional view taken along line 3—3 of FIG. 2, showing a knockout mechanism of the present invention.

As best seen in FIG. 3, one end of the knockout connecting rod on driving link 83 is mounted on the eccentric shaft 81 by a bearing and the other end of the link 83 is pivotally connected to the lower end of the rocker arm 80 so that when the eccentric shaft 81 is powered by a driving mechanism, the rocker arm 80 will be actuated to oscillate continuously. Moreover, the stroke of the rocker arm 80 can be freely adjusted by the eccentric shaft 84.

I claim:

1. A knockout mechanism for a high-speed automatic heading machine comprising:

a first eccentric shaft adapted to be driven by a source of power;

a second eccentric shaft;

a driving link mounted by bearing means on said first eccentric shaft;

a rocker arm pivotally connected to said driving link at a location spaced from a connection between said driving link and said first eccentric shaft, said rocker arm also being connected to said second eccentric shaft so that when said first eccentric shaft is driven, said rocker arm continuously oscillates; and knockout means secured to said rocker arm for ejecting a blank from a die of the heading machine.

2. The knockout mechanism of claim 1 wherein the length of the stroke of the rocker arm is adjusted by adjusting said second eccentric shaft.

3. The knockout mechanism of claim 1 wherein said knockout means includes an ejecting rod for ejecting said blank from said die and an adjustable ram bolt secured to said rocker arm for contacting said ejecting rod.

* * * * *